United States Patent [19]

Dishner

[11] Patent Number: 4,777,376

[45] Date of Patent: Oct. 11, 1988

[54] LIGHTWEIGHT STARTING SYSTEM FOR AN ELECTRICALLY COMPENSATED CONSTANT SPEED DRIVE

[75] Inventor: Bryan W. Dishner, Roscoe, Ill.

[73] Assignee: Sundstrand Corporation, Rockford, Ill.

[21] Appl. No.: 134,705

[22] Filed: Dec. 18, 1987

[51] Int. Cl.[4] ..... F02N 11/04

[52] U.S. Cl. ..... 290/4 R; 290/38 R; 322/40

[58] Field of Search ..... 290/4 R, 4 C, 31, 32, 290/38 R; 322/40; 318/14

[56] References Cited

U.S. PATENT DOCUMENTS

| | | | |
|---|---|---|---|
| 4,488,053 | 12/1984 | Cronin | 290/4 C |
| 4,572,961 | 2/1986 | Borger | 290/4 R |
| 4,694,187 | 9/1987 | Baker | 322/40 X |
| 4,695,776 | 9/1987 | Dishner et al. | 318/14 |
| 4,697,090 | 9/1987 | Baker et al. | 290/4 R |

*Primary Examiner*—William M. Shoop, Jr.
*Assistant Examiner*—W. E. Duncanson, Jr.
*Attorney, Agent, or Firm*—Wood, Dalton, Phillips, Mason & Rowe

[57] ABSTRACT

An electrically compensated constant speed drive includes controllable gear boxes in the speed compensation link of the drive which permit the overall speed ranges of the permanent magnet machines to be controlled, thus leading to a desirable decrease in size and weight of the machines.

10 Claims, 1 Drawing Sheet

LIGHTWEIGHT STARTING SYSTEM FOR AN ELECTRICALLY COMPENSATED CONSTANT SPEED DRIVE

FIELD OF THE INVENTION

The present invention relates generally to constant speed drives, and more particularly to a starting system for an electrically compensated constant speed drive (ECCSD).

BACKGROUND ART

Constant speed drives have been proposed for applications where it is desired to drive a generator at constant speed using a variable speed prime mover so that constant frequency electrical power is developed by the generator. Recently, advances in power electronics and control systems have resulted in the feasibility of electrically compensated constant speed drives (ECCSD) which utilize permanent magnet machines and a power converter in the speed compensation link of the drive. Such a drive is disclosed in Dishner et al. U.S. Pat. No. 4,695,776 (Sundstrand Docket No. B02150A-AT1-USA), assigned to the assignee of the instant application and the disclosure of which is hereby incorporated by reference.

It has been found that the permanent magnet machines in the speed compensation link of an ECCSD may be used to start the prime mover. In Baker et al. U.S. Pat. No. 4,697,090 (Sundstrand Docket No. B02277-AT1-USA), assigned to the assignee of the instant application and the disclosure of which is hereby incorporated by reference, an ECCSD is disclosed in which a differential speed summer includes a first input shaft coupled to an output shaft of a prime mover, a second input shaft coupled to an output shaft of a speed compensating permanent magnet machine and an output shaft coupled to a generator. A control permanent magnet machine includes a motive power shaft which is coupled to the output shaft of the prime mover or the output shaft of the differential. A power converter interconnects the electrical power windings of the permanent magnet machines. The system further includes means operable in a starting mode for operating the speed-compensating machine to cause the differential output shaft to rotate at increasing speeds. Once the synchronous speed of the generator is reached, power is applied to the output windings of the generator to cause the generator to operate as a motor. Thereafter, the speed compensating permanent magnet machine is operated to develop torque equal in magnitude to the torque developed by the generator. Starting torque is thus provided to the first input shaft of the differential to accelerate the prime mover to self-sustaining speed. Thereafter, the system operates in a generating mode so that constant frequency power is generated.

During operation in the starting mode, the torque provided by the speed-compensating permanent magnet machine may be developed by placing an electrical load thereon. In one embodiment, electrical power from the speed-compensating machine is provided to the control machine, which in turn develops additional starting torque which is delivered to the prime mover.

It has been found in this system that the speed-compensating machine must operate in the starting mode between zero speed and a multiple of full generator synchronous speed, and must operate in the generating mode in a speed range which is significantly less than its speed range in the starting mode. Thus the speed-compensating machine must operate over widely separated speed ranges. Further, the control permanent magnet machine operates in the starting mode up to a speed which is approximately 50% of its maximum speed during the generating mode. Thus, for a given machine power, the control permanent magnet machine must develop a large torque magnitude during operation in the starting mode.

A consequence of the foregoing is that the permanent magnet machines must be sized to accommodate the wide speed range differences and torque requirements in the starting and normal modes of operation. Thus, the machines are relatively large and heavy. This may prove to be a disadvantage in installations where small size and light weight are important, such as an aircraft or spacecraft.

DISCLOSURE OF INVENTION

In accordance with the present invention, an ECCSD utilizing permanent magnet machines in the speed compensation link of the drive is capable of starting a prime mover connected thereto, yet is light in weight and small in size.

More specifically, an ECCSD of the type described previously may be provided with controllable speed multipliers disposed between the speed compensating permanent magnet machine and the second differential input shaft and between the control permanent magnet machine and the prime mover or differential output shaft. This, in turn, allows the size and weight of the machines to be reduced, thereby leading to a desirable decrease in the size and weight of the overall drive.

The speed multipliers may be manually controlled, or may be controlled by signals developed by a generator control unit (GCU) so that fully automatic operation is accomplished. The present invention is also applicable to constant speed drives using rotary power converters other than permanent magnet machines in the speed compensation link.

BRIEF DESCRIPTION OF THE DRAWING

The sole FIGURE comprises a block diagram of an electrically-compensated constant speed drive including the starting system of the present invention.

BEST MODE FOR CARRYING OUT THE INVENTION

Figure 1:
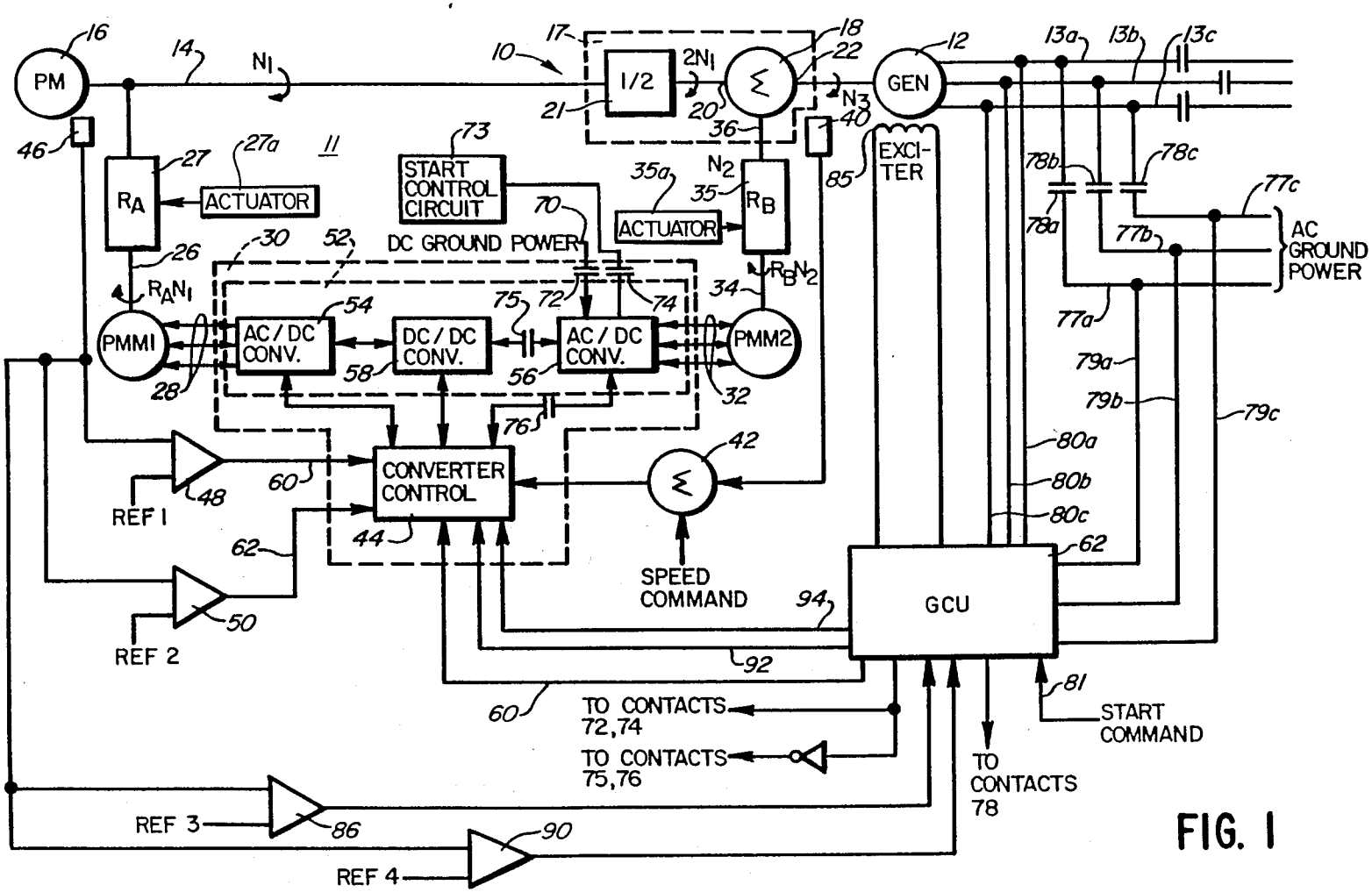

Referring now to the FIGURE, there is illustrated a generating system 10 which includes an electrically-compensated constant speed drive 11 for driving a generator 12 at a desired constant speed so that constant frequency AC main generator power is developed on power bus conductors **13*a*–13*c* to energize one or more loads (not shown). The constant speed drive 11 receives variable speed motive power from a shaft 14 which is driven by a variable speed prime mover 16. A gear box (not shown) may be coupled between the shaft 14 and the prime mover 16**, if desired.

The shaft 14 is coupled to a mechanical differential 17 having a speed summer 18. A mechanical disconnect unit (not shown) may be coupled between the shaft 14 and the differential 17, if desired. The differential 17 effects a 2:1 speed increase which is represented by a block 21. The differential further includes an output shaft 22 which is coupled to the generator 12.

A first or control permanent magnet machine PMM1 includes a motive power shaft 26 which is coupled by a controllable speed multiplier or gear box 27 to the output shaft 14. In an alternative embodiment, the gear box 27 is coupled to the differential output shaft 22. The PMM1 further includes electrical power windings which are coupled by a series of conductors 28 to a power converter 30.

A second or speed-compensating permanent magnet machine PMM2 includes electrical power windings which are coupled by a series of conductors 32 to the power converter 30. The PMM2 further includes a motive power shaft 34 which is coupled through a second controllable speed multiplier or gear box 35 to a second input 36 of the differential 17.

The speed multipliers 27,35 are preferably mechanical gear devices although different types of speed multiplier, such as a hydraulic or hydromechanical unit could be used, if desired.

The gear boxes 27,35 have variable speed or gear ratios of $R_{AY}$ and $R_B$, respectively. More specifically, if $N_1$ is the speed of the output shaft 14, the speed of the motive power shaft 26 of the PMM1 is equal to $R_A N_1$. Likewise, if the speed of the shaft coupled to the input 36 of the speed summer 18 is $N_2$, then the speed of the motive power shaft 34 of the PMM2 is equal to $R_B N_2$.

The gear boxes 27,35 may be manually controlled by actuators **27*a*,35*a*, respectively, or the actuators 27*a*,35*a* may be controlled automatically by a control mechanism or circuit, such as a generator control unit (GCU) 62 described in greater detail hereinafter. The speed of the output shaft 22 of the speed summer 18 is detected by a speed sensor 40. The speed sensor 40 develops a speed signal which is coupled to one input of a summing junction 42. A second input of the summing junction 42 receives a speed command signal representing the desired output speed of the speed summer 18. The summing junction 42 subtracts the two signals at the inputs and develops a speed error signal representing the difference between the actual output speed of the speed summer 18 and the commanded speed. The speed error signal is coupled to a converter control circuit 44 which is a part of the power converter 30**.

The speed of the output shaft 14 is detected by a second speed sensor 46 which develops a signal representative thereof. This signal is coupled to noninverting inputs of first and second threshold comparators 48,50. The comparators 48,50 include inverting inputs which receive reference signals REF1 and REF2, respectively. The outputs of these comparators are coupled to the converter control circuit 44 in the power converter 30.

The power converter 30 further includes power switching circuitry 52 which is controlled by the converter control 44 so as to operate the system 10 in a generating mode of operation. In one embodiment of the electricallycompensated constant speed drive 11, the power switching circuitry 52 comprises a first bi-directional AC/DC converter 54 which is coupled to the electrical power windings of the PMM1 by the conductors 28, a second bi-directional AC/DC converter 56 coupled to the electrical power windings of the PMM2 by the conductors 32 and a bi-directional DC/DC converter 58 which is coupled between and interconnects the AC/DC converters 54,56.

The converter control 44 also receives an enable signal on a line 60 from the GCU 62. The GCU controls the operational mode of the system (i.e. whether the system is operating the generating mode or in a starting mode) and controls the connection of the generator 12 to loads over a power distribution bus (not shown). The GCU may also operate the disconnect unit between the shaft 14 and the differential 17 in the event of a catastrophic failure of a component in the system.

While the generating system 10 is operating under normal operating conditions, during which time the system is operating in the generating mode, the enable signal is provided over the line 60 to the converter control 44. In response to this enable signal, the converter control 44 operates the power converters 54–58 to in turn control the transfer of power between the permanent magnet machines PMM1 and PMM2 so that the speed-compensating machine PMM2 drives the shaft coupled to the input 36 at a speed and in a direction which causes the speed of the output 22 to be maintained at a desired speed.

During operation in the generating mode, the speed ratios of the gear boxes 27,35 are established at fixed values so that the machines PMM1 and PMM2 operate within desired speed ranges.

The comparators 48,50 vary the operation of the converter control circuit 44 and the power switching circuitry 52 in dependence upon the speed $N_1$ of the shaft 14. More specifically, the speed $N_1$ may be such that it is necessary to operate the PMM1 as a generator and the PMM2 as a motor to provide compensating speed to the input 36 of the speed summer 18. In this case, the converter 54 is operated as a full bridge rectifier while the converter 56 is operated as an inverter under control of the converter control circuit 44.

On the other hand, the speed $N_1$ may be such that the PMM2 must be operated as a generator and the PMM1 must be operated as a motor, in which case the converter 56 is operated as a rectifier while the converter 54 is operated as an inverter.

Furthermore, the operation of the DC/DC converter 58 is varied as a function of the speed $N_1$ so that the proper voltage is applied to the converter 54,56 which is operating as an inverter.

It should be noted that if the range of speeds of the shaft 14 is limited with respect to the desired output speed $N_3$ such that the speed $2 \times N_1$ is always either below or above the speed $N_3$ (i.e. either below or above "straight through"), the power converters 54,56,58 and the converter control circuit 44 may be replaced by greatly simplified circuits which are unidirectional in nature. For example, the converters 54–58 may be replaced by a phase-controlled rectifier and an inverter coupled between the power windings 28,32 of the machines PMM1,PMM2, respectively. In this case, the converter control 44 would be replaced by a different control for operating the switches in the phase-controlled rectifier circuit and the inverter so that the PMM1 is always operated at a generator and the PMM2 is always operated as a motor.

The GCU 62 controls the application of external or ground power to the PMM2 and the generator 12. More specifically, one or more conductors 70 and contactors 72 connect a source of DC ground power or another DC source to the AC/DC converter 56. A start control circuit 73 is coupled by contactors 74 to the AC/DC converter 56 to control same when the system is operating in the starting mode, during which time a pair of contactors 75 and 76 are opened to disconnect the DC/DC converter 58 and the converter control 44 from the AC/DC converter 56. As noted more specifically below in connection with a further embodiment of the invention, the function of the start control circuit 73 may be assumed by the converter control 44, in which case the circuit 73 and the contactors 74 and 76 are not required.

Also, while the start control circuit 73 is illustrated as separate from the GCU 62, it should be understood that this circuit may be a part of the GCU, if desired.

A series of conductors *77a–77c* and contactors *78a–78c* connect an external or ground source of AC power to the power bus conductors *13a–13c*. The conductors 13 are in turn coupled to the armature windings of the generator 12. The GCU 62 senses the AC ground power and the voltages on the lines *13a–13c* over lines *79a–79c* and *80a–80c*, respectively, and controls the contactors *78a–78c* in accordance with such sensing, as noted in greater detail below.

The GCU 62 is responsive to a start command issued by an operator on a line 81. The start command, when issued, causes the GCU 62 to close the contactors 72 and 74 and to open the contactors 75 and 76. Power is thereafter developed on the lines 32 which is delivered to the PMM2 to cause it to operate as a motor. The start control circuit 73 controls the voltage and frequency of the power on the lines 32 to cause the PMM2 to be driven at increasing speeds until the speed $N_2$ reaches a predetermined speed. Specifically, the GCU 62 senses the power on the lines *13a–13c* and *77a–77c* to determine when a particular speed summer output speed is reached whereby the frequency and voltage of the power developed by the generator armature windings is the same as the frequency and voltage of the AC ground power. In the preferred embodiment, PMM2 is driven such that the speed $N_3$ of the output shaft 22 of the speed summer 18 reaches the synchronous speed of the generator 12, although this need not be the case if the ground power frequency is different than the normal generator output frequency. Once this condition is reached, the contactors *78a–78c* are closed and AC ground power is applied to the armature windings of the generator 12. The GCU controls the field current delivered to an exciter field winding 85 so that the generator 12 then begins to operate as a motor. The generator thereafter develops motive power which is returned through the differential 17 and the prime mover output shaft 14 to the prime mover 16 to start same and bring it up to operating speed.

It should be noted that during the starting procedure, the enable signal on the line 60 is removed from the converter control 44. In response to this removal of the enable signal, the converter control 44 opens the switches in one or more of the power converters 54 and 58 so that these converters are disabled.

Once the generator 12 develops motive power and delivers torque to the differential, PMM2 is operated by the start control circuit 73 so that it develops torque equal in magnitude to the torque developed by the generator 12. The direction of the torque developed by the PMM2 is such as to cause starting torque to be developed at the input 20 so that the speed of the shaft 14 increases in the desired direction.

A level comparator 86 develops a high state signal when the speed of the prime mover 16, as detected by the speed sensor 46, exceeds a predetermined or starting speed represented by a reference signal REF3. The high state signal developed by the operational amplifier 86 is detected by the GCU 62, which in turn opens the contactors 72,74,78 and closes the contactors 75,76. The AC ground power and DC ground power are thus disconnected from the generator armature windings and the AC/DC converter 56 and the converter 56 is coupled to the DC/DC converter 58 and the converter control 44. The GCU 62 thereafter issues an enable signal over the line 60 when the normal operating speed of the prime mover 16 is reached so that the converter control 44 operates the converters 54,56,58 to manage the flow of power between the machines PMM1 and PMM2. The detection of when the normal operating speed is reached is accomplished by sensing the output of a further level comparator 90 which develops a high state signal when the speed of the prime mover 16 exceeds a reference speed represented by a further reference signal REF4.

Once the converters 54,56,58 are under control of the converter control circuit 44, the generating system 10 is in the generating mode and the GCU 62 controls the exciter field current in a known fashion.

The operation of the GCU 62 in the generating mode will not be described in greater detail, it being understood that this operation is conventional in nature.

It should be noted that a separate power converter may be used instead of the converter 56 to control the PMM2 in the starting mode, if desired. In this case, it may be necessary to disconnect the converter 56 from the PMM2 when operating in the starting mode.

Further, the ground or external power may be provided by single or separate power supplies, as desired.

In an alternative embodiment of the invention briefly described hereinbefore, the function of the start control circuit 73 is incorporated into the GCU 62 so that the start control circuit 73 and the contactors 74 and 76 are not required. In this case, the converter control 44 effects a normal operational control in which the output speed of the differential 17 is controlled. During this time, the output speed $N_3$ of the differential 17 as detected by the sensor 40 is compared against the speed command by the summing junction 42 and the resulting speed error is utilized by the converter control 44 to operate the switches in the converter 56 to minimize the error. This normal control is used during start-up prior to the time that the generator 12 is brought into synchronism with the AC ground power on the lines 77 and is also used during normal operation of the constant speed drive while in the generating mode.

A further operational control referred to as a "torque control" is effected by the converter control 44 during the start-up sequence after the contactors *78a–78c* have been closed. During this time, the generator develops torque at the shaft 22 which must be balanced by an equal torque on the shaft 36. This balancing torque which must be developed by the PMM2 is a braking torque, and hence power flow occurs from the differential and PMM2 into the converter 56. During this torque control, the converter control circuit 44 responds to a torque command from the GCU 62 over a line 92 and the error signal from the summing junction 42 is ignored. The torque command signal issued by the GCU 62 may be constant or could be a function of the prime mover speed or other parameters in the system.

The GCU operates the converter control circuit 44 in the normal control or torque control operation in dependence upon the state of a signal developed by the GCU 62 and transmitted over a line 94. In this embodiment, the GCU does not disable the converter control 44 and hence the line 60 is not needed and the control 44 is continuously operative. Further, the converter control 44 should not only be capable of normal operational control during start-up and steady state operation and be capable of torque control during start-up but should also be capable of disabling the switches in one or more of the converters 54,56,58 in the event of a fault.

Also, it should be noted that the speed command signal coupled to the summing junction 42 as well as the torque command signal previously mentioned may be developed by the GCU 62 so that the GCU may account for variations in AC ground power frequency and torque requirements for starting of the prime mover. The torque command signal may be derived from a look-up table or may be derived in another fashion, as desired.

The prime mover can be started with or without torque contribution from the machine PMM1, provided PMM2 can supply the necessary balancing torque if the latter approach is followed. In one embodiment, balancing torque from the machine PMM2 is provided by transferring power from PMM2 to an external power source connected to the power converter 30. In this embodiment, the machine PMM1 does not receive power from PMM2 and hence does not contribute starting torque. In another embodiment, the machine PMM1 is provided electrical power by PMM2 and the power converter 30 at increasing voltage and frequency while in the starting mode after the generator 12 is operating as a synchronous motor to provide torque to the shaft 14 until prime mover self-sustaining speed is reached. Inasmuch as the point of connection of the gear box 27 to the differential 17 comprises a torque summer, the machine PMM1 operates in this embodiment to supply a portion of the required starting torque, thus reducing the torque demands on the machine PMM2.

If the current capability of PMM1 is less than the current which must be drawn from PMM2 to produce the necessary balancing torque, some current must be shunted away from PMM1 to an external load or returned to an external power source. If PMM1 is designed to handle all of the current supplied by PMM2, however, the external load is not needed, and no power need be returned to the source.

Additional detail concerning the operation of the system shown in the FIGURE may be obtained by reference to Baker et al. U.S. Pat. No. 4,697,090 and Dishner et al. U.S. Pat. No. 4,695,776, identified above.

In the Baker et al '090 patent, the speed ratios of the gear boxes 27,35 are fixed. Thus, PMM1 must operate in different speed ranges in the generating and starting modes. For example, assume that the prime mover operates in the generating mode in a speed range between 1.0 $N_O$ and 1.7 $N_0$, where $N_O$ is the idling speed of the prime mover 16. Also, assume that the system is configured so that the straight-through condition occurs at a prime mover speed equal to 1.35 $N_O$ and that the prime mover 16 reaches self-sustaining speed at half its maximum speed, or 0.85 $N_O$. Further, PMM1, when operating in the generating mode, handles only a small fraction of the torque provided by the prime mover 16 while it is required to develop a larger magnitude of torque during operation in the starting mode. Under these assumptions it can be seen that the machine PMM1, when in the starting mode, operates over a speed range between zero and 0.85 $R_A$ $N_O$, while this machine operates in a speed range between 1.0 $R_A$ $N_O$ and 1.7 $R_A$ $N_O$ in the generating mode. If the speed ratio $R_A$ is fixed, it can be seen that PMM1 operates in the starting mode up to only half its maximum speed in the generating mode. If the speed of PMM1 during operation in the starting mode could be increased, it would be possible to reduce its required torque in the starting mode and thus permit a decrease in the size of PMM1.

As a practical matter, it would not prove advantageous to reduce the starting torque requirements placed on the machine PMM1 below that required for normal operation in the generating mode. Thus, the gear ratio $R_A$ need not be increased in the starting mode beyond the point at which the starting torque delivered by PMM1 is less than the torque supplied by such machine in the generating mode.

Hence, in the present invention, the gear ratio $R_{A\ Y}$ is established at a first value by means of the actuator 27A during operation in the starting mode and is established at a second value during operation in the generating mode. As noted previously, the actuator 27A may be dispensed with and the speed ratio control may be assumed by the GCU 62.

Insofar as the machine PMM2 is concerned, if the torque required from this machine during operation in the starting mode is less than the torque handled in the generating mode, then the size of this machine can be reduced for a given machine power. This can be accomplished by establishing the gear ratio $R_B$ of the gear box 35 at a value during the starting mode which reduces the overall operating speed range of PMM2. In the previous example, the speed of the second differential shaft 36 varies in the starting mode between 1.35 $N_O$ and 0.5 $N_O$ while in the generating mode, the speed of the shaft 36 varies between $+0.35$ $N_O$ and $-0.35$ $N_O$. This wide variation in overall speed range over both the generating and starting modes can be reduced by changing the gear ratio $R_B$ in the starting mode so that the speed of the machine in this mode is reduced. In this case, it is desirable to balance the reduction in speed range against the increased torque requirements resulting therefrom so that the size of the machine PMM2 is minimized.

Set forth below is a table illustrating the operating characteristics of: (1) an ECCSD which is not designed for starting of the prime mover 16; (2) an ECCSD having prime mover start capability in which PMM1 is capable of handling all of the current supplied by PMM2 but in which the gear boxes 27, 35 have fixed gear ratios; (3) an ECCSD identical to (2) except that the gear boxes 27,35 have variable gear ratios; (4) an ECCSD having prime mover start capability where PMM1 is not capable of supporting all of the current supplied by PMM2 so that the power converter 30 must be used to shunt current away from PMM1 and in which the gear boxes 27, 35 have fixed gear ratios; and (5) a system identical to (4) except that the gear boxes 27,35 have variable gear ratios. It is assumed that the starting torque on each of the shafts 20, 22, 36 of the speed summer 18 equals the torque on each shaft during operation in the generating mode. Also, the speed range of the prime mover in the generating mode is assumed to vary between $N_O$ and 1.7 $N_O$.

(The torques in the table are normalized to differential torque at rated electrical load on the generator 12)

| | (1) | (2) | (3) | (4) | (5) |
|---|---|---|---|---|---|
| PMM1 Max Torque | $.467 \times 2/R_{AG}$ | $1.0 \times 2/R_{AG}$ | $0.5 \times 2/R_{AG}$ | $.467 \times 2/R_{AG}$ | $.467 \times 2/R_{AG}$ |
| PMM1 Max Speed | $1.7\ R_{AG}N_O$ | $1.7\ R_{AG}N_O$ | $1.7\ R_{AG}N_O$ | $1.7\ R_{AG}N_O$ | $1.7\ R_{AG}N_O$ |
| PMM2 Max Torque | $1/R_{BG}$ | $1/R_{BG}$ | $1/R_{BG}$ | $1/R_{BG}$ | $1/R_{BG}$ |
| PMM2 Max Speed | $0.35\ R_{BG}N_O$ | $1.35\ R_{BG}N_O$ | $.937\ R_{BG}N_O$ | $1.35\ R_{BG}N_O$ | $.937\ R_{BG}N_O$ |
| $R_{AS}/R_{AG}$ | 1/1 | 1/1 | 2/1 | 1/1 | 2/1 |
| $R_{BS}/R_{BG}$ | 1/1 | 1/1 | .694/1 | 1/1 | .694/1 |

where $R_{AS}$ and $R_{BS}$ are the values of $R_A$ and $R_B$ in the starting mode and $R_{AG}$ and $R_{BG}$ are the values of $R_A$ and $R_B$ in the generating mode.

As noted above, the basic drive without start capability is represented by example (1). An ideal drive incorporating start capability would not increase the requirements placed upon the machines PMM1 and PMM2 so that the sizes of these machines need not be increased. However, as a practical matter, the maximum torque developed by PMM1 and/or the maximum speed developed by PMM2 must be increased in order to accomplish the start function.

More specifically, as illustrated by example (2), start capability can be provided by simply increasing the torque capacity of PMM1 and the speed range of PMM2 while keeping the speed ratios RA and RB fixed in the starting and generating modes. This arrangement results in an increase in the sizes of PMM1 and PMM2.

The drive illustrated by example (3) is identical to example (2) except that the gear ratios RA and RB are different in the generating and starting modes. The increase in torque capability of PMM1 and the increase in speed range of PMM2 are less for example (3) than for example (2). Thus, the machines PMM1 and PMM2 need not be as large in example (3) as in example (2).

Example (4) is identical to example (2) except that a power converter or other power handling device routes the power developed by PMM2 away from PMM1. Thus, the torque capability of PMM1 need not be increased beyond the torque requirements placed on it during operation in the generating mode. This leads to a desirable decrease in the size of PMM1 as compared with example (2). However, the speed range of PMM2 is the same in examples (2) and (4), and hence this machine cannot be reduced in size.

Example (5) illustrates that the size of PMM2 in example (4) can be reduced if the gear boxes 27,35 have variable gear ratios. In this example, the speed range of PMM2 is not as wide as it is in example (4) and the amount of power that is developed by PMM2 is reduced. In addition, the size of PMM1 need not be increased over example (1).

The use of controllable gear boxes 27,35 results in the ability to use smaller machines for a given starting capability. This in turn allows the size and weight of the overall ECCSD to be reduced while still providing prime mover start capability.

It should be noted that the concepts disclosed herein are also applicable to other types of constant speed drives having prime mover start capability. In this case, one or both of the permanent magnet machines PMM1 and PMM2 are replaced by another type of rotary power converter, for example wound field generators and motors, hydraulic pumps and motors, or the like. In each case, the rotary power converters include interconnected power paths analogous to the interconnected power windings of the machines PMM1 and PMM2. A motive power shaft of one of the rotary power converters is coupled by the gear box 27 to the output shaft 14 of the prime mover 16 or to the output shaft 22 of the differential 17. The other rotary power converter includes the motive power shaft which is coupled by the gear box 35 to the second input 36 of the differential 17.

In addition, in each of the foregoing cases, only one of the gear boxes may be of the variable speed or ratio type, if desired.

What is claimed is:

1. In a constant speed drive of the type including a differential having a first input shaft coupled to an output shaft of a prime mover, a second input shaft and an output shaft coupled to a generator and a speed compensation link coupled between the prime mover and the second differential input shaft wherein the speed compensation link includes first and second rotary power converters having interconnected power paths and motive power shafts and wherein the drive is operable in a generating mode to convert variable-speed motive power supplied by the prime mover into constant-speed motive power for the generator and in a starting mode to bring the prime mover up to self-sustaining speed, the improvement comprising:

first and second speed multipliers coupled between the motive power shaft of the first rotary power converter and either of the prime mover and the differential output shafts and between the motive power shaft of the second rotary power converter and the differential second input shaft, respectively, wherein at least one of the speed multipliers has a variable speed ratio which is established at different values in the generating and starting modes.

2. The improvement of claim 1, wherein both of the speed multipliers have variable speed ratios established at different values in the generating and starting modes.

3. The improvement of claim 1, wherein the speed multipliers comprise mechanical gear boxes.

4. The improvement of claim 1, wherein the first and second rotary power converters comprise electromechanical machines.

5. The improvement of claim 1, wherein the speed multipliers are controlled by manual actuators.

6. The improvement of claim 1, wherein the speed multipliers are controlled by a generator control unit.

7. An electrically compensated constant speed drive (ECCSD) coupled between a variable speed prime mover and a generator, comprising:

a mechanical differential speed summer including a first input shaft coupled to an output shaft of the prime mover, a second input shaft and an output shaft coupled to the generator;

first and second permanent magnet machines each having electrical power windings and a motive power shaft;

A first controllable speed multiplier interconnecting the motive power shaft of the first permanent magnet machine and the output shaft of the prime mover or the differential;

a second controllable speed multiplier interconnecting the motive power shaft of the second permanent magnet machine and the second input shaft of the differential;

a power converter interconnecting the electrical power windings of the first and second permanent magnet machines;

means for operating the permanent magnet machines and the generator in a generating mode whereby constant-frequency electrical power is developed by the generator or in a starting mode whereby motive power is transferred to the prime mover to bring it up to self-sustaining speed; and means for controlling the speed multipliers in the generating and starting modes so that the first permanent magnet machine operates over substantially the same speed range in both modes;

and so that the torque developed by the second permanent magnet machine in the starting mode is no greater than the torque developed by such machine in the generating mode.

8. The ECCSD of claim 7, wherein the controlling means comprises first and second manual actuators coupled to the first and second speed multipliers, respectively.

9. The ECCSD of claim 7, wherein the speed multipliers have variable gear ratios and wherein the controlling means comprises a generator control unit which automatically controls the gear ratios of the speed multipliers.

10. The ECCSD of claim 7, wherein the speed multipliers comprise mechanical gear boxes.

* * * * *